United States Patent [19]

Hollingsworth

[11] Patent Number: 4,955,835

[45] Date of Patent: Sep. 11, 1990

[54] STORAGE CAPSULE FOR SURFBOARD OR THE LIKE

[76] Inventor: Dean E. Hollingsworth, 371 Andrew Ave., Encinitas, Calif. 92024

[21] Appl. No.: 270,097

[22] Filed: Nov. 14, 1988

[51] Int. Cl.[5] ..... B63B 19/00

[52] U.S. Cl. ..... 441/74; 114/201 R; 114/174

[58] Field of Search ..... 441/65, 74, 75; 114/39.2, 173, 174, 175, 201 R; 220/298, 301, 304

[56] References Cited

U.S. PATENT DOCUMENTS

| | | | |
|---|---|---|---|
| 1,853,159 | 4/1932 | Welsh . | |
| 3,396,712 | 8/1968 | Sakraida et al. | 114/201 R |
| 4,194,458 | 3/1980 | Messing | 114/39.2 |
| 4,280,434 | 7/1981 | Beckerer | 114/174 |
| 4,545,772 | 10/1985 | Stockhausen | 441/74 |

FOREIGN PATENT DOCUMENTS

| | | |
|---|---|---|
| 3030469 | 8/1980 | Fed. Rep. of Germany . |
| 3107065 | 2/1981 | Fed. Rep. of Germany . |
| 3325819 | 7/1983 | Fed. Rep. of Germany . |

*Primary Examiner*—Sherman D. Basinger
*Assistant Examiner*—Stephen P. Avila
*Attorney, Agent, or Firm*—Brown, Martin, Haller & McClain

[57] ABSTRACT

An apparatus for mounting in a surfboard or the like for storing articles therein having a housing, a lid and a gasket member mounted upon the lid for providing a watertight seal between the housing and lid. The housing is cylindrical and has a closed end and an open end with at least one retaining rib and an annular shoulder formed interior of the housing adjacent the open end. A cylindrical lid is adapted for mounting upon the housing and has a handle member formed at one end and at least one locking rib formed on the periphery of the lid for engaging a respective retaining rib. A gasket member is mounted upon the periphery of the lid for engaging the housing ridge.

11 Claims, 1 Drawing Sheet

STORAGE CAPSULE FOR SURFBOARD OR THE LIKE

BACKGROUND OF THE INVENTION

I. Field of the Invention

The present invention relates to articles for storing objects. More specifically, the present invention relates to a novel and improved storage capsule for mounting in a surfboard or the like, at the deck thereof, for providing watertight storage of objects placed within the capsule.

II. Description of the Related Art

In water sports such as windsurfing and surfboarding, it is often desirable to keep certain personal objects such as keys, surf wax, sun protection or other small items on the person while participating in the sport. In many cases, it is not possible or impractical to safely keep such objects on the person while participating in the sport.

Several previous attempts have been made at devising storage containers adapted for mounting in sailboards. The result of each of these attempts have resulted in a rather basic storage capsules which on occasion would interfere in the use of the equipment by the participant. Typically, these storage containers are rather large, bulky along with being difficult to use. Storage containers previously developed for sailboards were typically mounted in or at the rear end of the sailboard. These devices generally include a mechanism, typically screws, for attaching a lid thereto. Gaining access to the storage area thus became a significant task.

It is, therefore, an object of the present invention to provide a new and improved storage capsule for mounting in a surfboard, sailboard or the like for storing objects therein.

It is yet a further object of the invention to provide a storage capsule which is flush-mounted with the deck of a surfboard, sailboard or the like which provides watertight storage of objects with ready access thereto.

SUMMARY OF THE INVENTION

The present invention comprises a new and improved storage capsule for mounting in a surfboard, sailboard or the like, at the deck thereof for providing easy access to and watertight storage of objects placed within the capsule. In a preferred embodiment, the capsule comprises a substantially cylindrical hollow cup or housing having a circumferential side wall, an open end and a closed end. The closed end is formed by an end wall integrally formed with the side wall. The side wall has an annular shoulder formed thereupon within the interior of the housing adjacent the open end. A plurality of retaining ribs are formed upon the side wall within the housing interior between the shoulder and the end wall.

The capsule further includes a lid for mating with the housing. The lid is substantially cylindrical having a circumferential side wall, an open end and a closed end. The lid closed end is formed by an end wall integrally formed with the lid side wall. The lid end wall includes an integrally formed peripheral flange and handle member. The lid side wall has a plurality of peripheral locking ribs formed thereupon adjacent the lid open end. Each locking rib is used in securing the lid to the housing by engaging a respective housing retaining rib. The lid further includes a peripheral annular shoulder formed adjacent the lid closed end such that a groove is defined by the flange and lid shoulder. An O-ring is mounted upon the lid in the groove to provide watertight sealing of the capsule when the lid is secured to the housing. The lid when mounted upon the housing is positioned within the region defined by the housing side wall.

The capsule is typically mounted in a surfboard or sailboard with the upper rim of the housing side wall and the lid being flush with the top surface of the deck. Placement of the lid at the housing open end within the region defined by the housing side wall, and slight rotation of the lid secures the lid to the housing. Thus, the present invention encompasses a watertight storage capsule, to which easy access is available, and minimizes with use of the surfboard or sailboard.

BRIEF DESCRIPTION OF THE DRAWINGS

These and other features, objects and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENT

Figure 1:
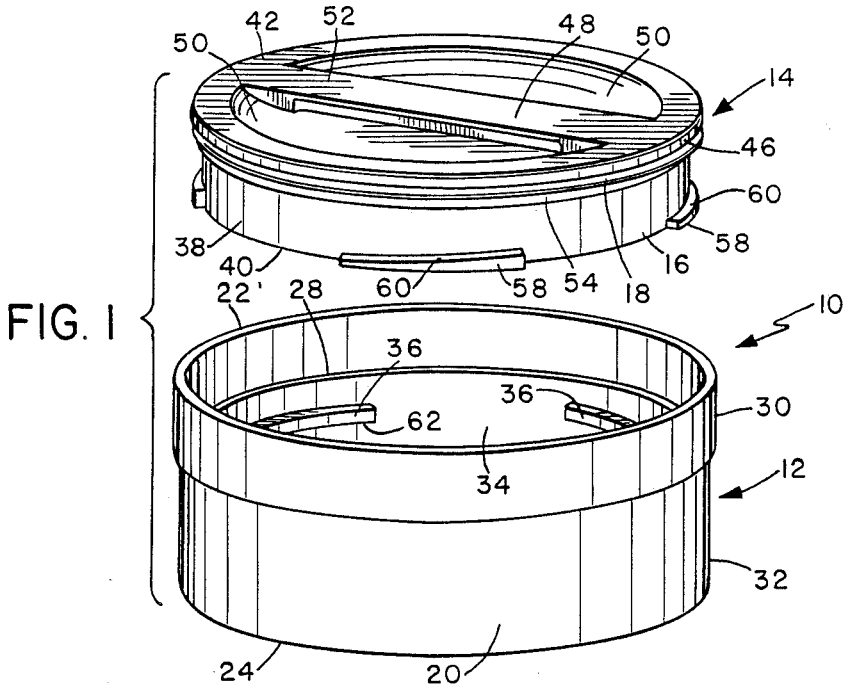
FIG. 1 is an exploded perspective view of the storage capsule of the present invention.

The present invention comprises a novel and improved storage capsule for mounting in a surfboard, sailboard or the like for the storage of small objects within the capsule. With reference to FIG. 1, storage capsule 10 is comprised of a housing or cup 12 and a lid assembly 14. Lid assembly 14 is comprised of a lid 16 and a gasket member or O-ring 18. Cup 12 and lid 16 are typically fabricated by an injection molding process from a material such as ABS plastic. O-ring 18 is typically formed from rubber, synthetic rubber or any other suitable compressible material. O-ring 18 is included in the lid assembly to ensure a watertight seal between cup 12 and lid 16.

Cup 12 is substantially cylindrical in shape while having a hollow interior. Cup 12 is defined by a circumferential side wall 20 while having an open end 22 and a closed end 24. Closed end 24 is closed by end wall 26 (FIG. 3) integrally formed with side wall 20. Adjacent open end 22 is a continuous annular shoulder 28 that is formed in side wall 20 with the interior of cup 12. Shoulder 20 is typically formed at the intersection of an upper portion 30 of cup 12, adjacent open end 22, and a lower portion 32 adjacent closed end 24. Accordingly, the inner diameter of side wall 22 in upper portion 30 is slightly greater than that of lower portion 32.

Formed upon an interior surface 34 of side wall 22 in the lower portion 32, are a series of retaining ribs 36. In the embodiment illustrated in FIG. 1, four spaced apart remaining ribs 36 are equal angularly displaced about the inner circumference of side wall 22. Retaining ribs 36 are typically integrally formed with side wall 20 and are preferably of a length corresponding to an arc of 40° of side wall 20. Retaining ribs 36 are typically tilted at an angle of approximately 4° with respect to a plane perpendicular to a common axis of rotation of side wall 20.

Lid 14 is typically cylindrical in shape while also having a hollow interior. Lid 14 is defined by a circumferential side wall 38, an open end 40 and a closed end 42. Closed end 42 is closed by an end wall 44 integrally formed with side wall 38.

Figure 3:
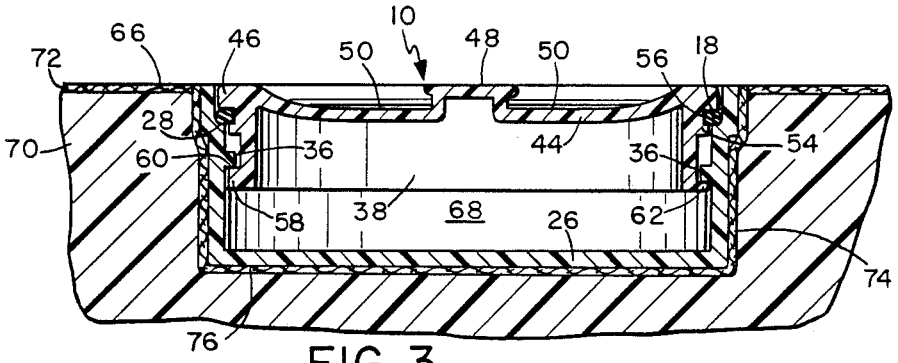
FIG. 3 is an enlarged sectional view taken on line 3—3 FIG. 2.

Lid end wall 44 includes a peripheral flange 46 and an integrally formed handle member 48. Handle member 48 is formed in end wall 44 by two symmetrically formed D-shaped depressions 50 which define a cross member 52. Formed in side wall 38, adjacent flange 46, is a peripheral annular shoulder 54 with which defines groove 56 (FIG. 3). O-ring 18 is positioned within groove 56 defined by flange 46 and shoulder 54.

Adjacent open end 40 and formed upon the exterior of side wall 38 are four locking ribs 58. Locking ribs 58 are equally spaced apart about the periphery of side wall 38. The distance between locking ribs 58 is an arc of approximately 45°. Each locking rib 58 has an upper surface 60 which is at a tilt of an angle of approximately 4° with respect to a plane taken perpendicular to an axis of rotation of side wall 38. Each locking rib 58 has an angled upper surface 60 so as to provide threaded engagement with the angled lower surface 62 of relating ribs 36.

To close storage capsule 10 when open, lid assembly 14 is positioned with lid open end 40 facing cup open end 22. Lid assembly 14 is seated within the interior of cup 12 as defined by side wall 20 and end wall 26. With locking ribs 58 aligned with the spacing between retaining ribs 36, lid assembly 14 is seated with O-ring 18 resting upon shoulder 28. Lid assembly 14 is rotated clockwise with the locking rib upper surface 60 engaging retaining rib lower surface 62. The angled surfaces 60 and 62, during rotation of lid assembly 14, provide secure engagement between lid 16 and cup 12 along with compression of O-ring 18. Compression of O-ring 18 between lid 16 and shoulder 28 provides a watertight seal between lid 16 and cup 12.

Figure 2:
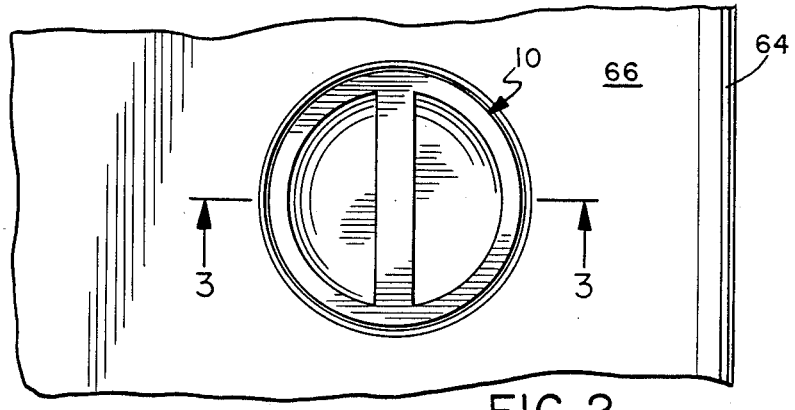
FIG. 2 is a top plan view of a typical installation of the capsule in a surfboard.

FIG. 2 illustrates a top plan view of storage capsule 10 mounted in surfboard 64. Storage capsule 10 is mounted flush with the deck or top surface 66 of surfboard 64.

FIG. 3 illustrates storage capsule 10 mounted in surfboard 64 taken in cross-section along an off-centered plane as indicated by line 3—3 of FIG. 2. Storage capsule 10 is illustrated in FIG. 3 with lid assembly 14 positioned in a locked relationship with cup 12. With lid assembly 14 in a locked position, lid 16 is flush with surfboard top surface 66. Upper surface 60 of each locking rib 58 is engaged with lower surface 62 of a corresponding retaining rib 36 when lid assembly 14 is rotated into the locked position. O-ring 18 seated within groove 56 is compressed between lid 16 and cup 12 at shoulder 28 to provide a secure watertight seal of the interior 68 of capsule 10.

Typically during the fabrication of storage capsule 10, side wall 20 in the region of cup upper portion 30 is typically greater in height than that illustrated in FIG. 1. The upper rim of upper portion 30 typically includes three equal angular spaced apart tabs which extend radially outwardly from an upper rim of side wall 20. These tabs along with the extension of side wall 20 in portion 30 are removed during installation of storage capsule 10 to enable lid 16 and cup 12 to be flush with surfboard top surface 66.

Surfboard 64 is typically comprised of a plastic foam core 70 surrounded by an outer rigid fiber-reinforced plastic shell 72 which is comprised of a synthetic fiber cloth impregnated with an epoxy resin. To install storage capsule 10, a cylindrical hole 74 is formed at top surface 66 through shell 72 into core 70. Prior to placement of storage capsule 10 into hole 74, the outer surfaces of side wall 22 and end wall 24 are roughened, typically by sanding, to provide improved bonding surfaces. In installing storage capsule 10 in hole 74, a layer of woven synthetic fiber cloth 76 is positioned in hole 74 and impregnated typically with a mixed two-part epoxy. The epoxy-impregnated cloth 76 bonds cup 12 within hole 74. With cup 12 installed in surfboard 64, the extension of upper portion 30 extending above top surface 66 is sanded down to achieve flush mounting with the upper rim 70 of cup 12 and the top of lid 16 when installed.

In the preferred embodiment of the invention, the height of the installed storage capsule is approximately 1 3/16 inches deep and approximately 3½inches in diameter. In the embodiment disclosed herein, the capsule provides approximately six cubic inches of storage capacity. The storage capsule of the present invention may be installed either during the initial fabrication of a surfboard or retrofitted in a finished surfboard. The storage capsule of the present invention as described herein is capable of providing secure, watertight storage of objects while eliminating interference to an individual when surfing or sailboarding.

The previous description of the preferred embodiment is provided to enable any person skilled in the art to make or use the present invention. Various modifications to this embodiment will be readily apparent to those skilled in the art, and the generic principals defined herein may be applied to other embodiments without the use of the inventive faculty. Thus, the present invention is not intended to be limited to the embodiment shown herein, but is to be accorded the widest scope consistent with the principals and novel features disclosed herein.

I claim:

1. An apparatus for mounting in surfboard or a means for storing articles therein, comprising:

a cylindrical housing having a closed end and an open end, said housing having at least one integral, mateable retaining rib formed on its inner surface, and an annular shoulder formed on its inner surface adjacent said open end;

a cylindrical lid having a closed end and a cylindrical skirt portion depending from said closed end for close engagement in the upper open end of said housing, a handle member formed at the outer surface of said closed end and at least one integral mating locking rib formed on the outer surface of said skirt portion for mating, locking engagement with said mating retaining rib on the inner surface of said housing;

a gasket member mounted upon the outer surface of said skirt portion adjacent said closed end of said lid for engaging said housing shoulder;

said lid and housing being flush mounted within said surfboard means a board for surfing or sailing.

2. The apparatus of claim 1 wherein said annular shoulder is formed between said open end and said retaining rib.

3. The apparatus of claim 1 wherein said lid has a flange formed at said lid closed end and an outer peripheral shoulder adjacent said flange forming a groove therebetween, said gasket member mounted within said groove.

4. The apparatus of claim 1 wherein said lid fits within said housing when coupled thereto.

5. A storage capsule for mounting in surfboard or a means at the deck thereof for providing waterproof storage of objects positioned within said capsule, said capsule comprising:

a substantially cylindrical, hollow housing having a circumferential housing side wall, an open end and a closed end closed by a housing end wall integrally formed with said side wall, the inner surface of said housing side wall having a housing annular shoulder formed thereupon within said housing adjacent said housing open end and a plurality of circumferentially spaced retaining ribs formed thereupon within said housing between said shoulder and said housing end wall;

a substantially cylindrical lid having a circumferential lid side wall for fitting within said housing, an open end and a closed end closed by a lid end wall integrally formed with said lid side wall wherein said lid end wall has a peripheral flange and an integrally formed handle member, the outer surface of said lid side wall having a plurality of circumferentially spaced peripheral locking ribs formed thereupon adjacent said lid open end with each locking rib comprising means for locking engagement with a respective retaining rib, and a lid peripheral annular shoulder formed adjacent said lid closed end; and an O-ring mounted upon said lid in an outwardly facing groove formed on the outer surface of said side wall between said flange and lid shoulder.

6. The storage capsule of claim 5 wherein said housing and lid are formed of a durable, rigid plastic material, and said O-ring is formed of a compressible material.

7. The storage capsule of claim 5 wherein the outer diameter of said lid side wall is smaller than the inner diameter of said housing side wall, said lid being received within said housing side wall for engagement with said housing.

8. The storage capsule of claim 5 wherein said handle member comprises a pair of depressions formed in said lid end wall and a central cross member.

9. The storage capsule of claim 5 wherein said lid and housing are flush mounted within said surfboard means a surfboard.

10. The storage capsule of claim 5 wherein said lid and housing are flush mounted within said surfboard means a sailboard.

11. The storage capsule of claim 5, wherein there are four circumferentially spaced retaining ribs around the periphery of said housing side wall and four similarly spaced locking ribs around the periphery of said lid side wall for threaded engagement beneath said retaining ribs when said lid is mounted in said housing, the regaining ribs having angled lower surfaces and the locking ribs having similarly angled upper surfaces for threaded, locking engagement with the respective retaining ribs as the lid is rotated through one quarter turn relative to the housing.

* * * * *

UNITED STATES PATENT AND TRADEMARK OFFICE

CERTIFICATE OF CORRECTION

PATENT NO. : 4,955,835

DATED : September 11, 1990

INVENTOR(S) : Dean E. Hollingsworth

It is certified that error appears in the above-identified patent and that said Letters Patent is hereby corrected as shown below:

```
Column 4, claim 1, line 40, delete "or a";
Column 4, claim 1, line 60, delete "a board";
Column 5, claim 5, line 3, delete "or a";
Column 6, claim 9, line 14, after "means"
   insert --comprising--;
Column 6, claim 10, line 18, after "means"
   insert --comprising--;
```

Signed and Sealed this

Twelfth Day of May, 1992

*Attest:*

DOUGLAS B. COMER

*Attesting Officer*

*Acting Commissioner of Patents and Trademarks*